US008205973B2

(12) United States Patent
Nitta et al.

(10) Patent No.: US 8,205,973 B2
(45) Date of Patent: Jun. 26, 2012

(54) INK JET RECORDING APPARATUS, INK SUPPLYING MECHANISM AND INK JET RECORDING METHOD

(75) Inventors: Noboru Nitta, Tagata-gun (JP); Masashi Shimosato, Izunokuni (JP); Hideaki Nishida, Izunokuni (JP); Isao Suzuki, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 428 days.

(21) Appl. No.: 12/580,954

(22) Filed: Oct. 16, 2009

(65) Prior Publication Data

US 2010/0134539 A1 Jun. 3, 2010

Related U.S. Application Data

(63) Continuation of application No. 11/617,246, filed on Dec. 28, 2006, now abandoned.

(51) Int. Cl.
*B41J 2/175* (2006.01)

(52) U.S. Cl. ..... 347/85; 347/89

(58) Field of Classification Search ..... 347/7, 84, 347/85, 89

See application file for complete search history.

(56) References Cited

U.S. PATENT DOCUMENTS 4,404,566 A * 9/1983 Clark et al. ..... 347/89
4,527,175 A * 7/1985 Kojima et al. ..... 347/85
6,007,193 A 12/1999 Kashimura et al.
6,443,560 B1 9/2002 Okano et al.
7,044,579 B2 5/2006 Katsuumi
7,401,907 B2 * 7/2008 Perez ..... 347/84
7,594,717 B2 * 9/2009 Sheinman ..... 347/89
2002/0118256 A1 8/2002 Dixon et al.
(Continued)

FOREIGN PATENT DOCUMENTS

JP 10-114081 5/1998
(Continued)

OTHER PUBLICATIONS

Japanese Office Action for Japanese Application No. 2007-355297 mailed on Jan. 31, 2012.

*Primary Examiner* — Anh T. N. Vo
(74) *Attorney, Agent, or Firm* — Turocy & Watson, LLP

(57) ABSTRACT

An ink jet recording apparatus according to an embodiment of the invention includes an ink jet head having a pressure chamber facing a nozzle, and an upstream port and a downstream port connected to the pressure chamber, a main tank connected to the ink jet head via the upstream port and capable of storing ink therein, and a sub-tank connected to the ink jet head via the downstream port and capable of storing ink, wherein at least when printing by ejecting ink from the nozzle, the relation between ph, r, R and Q is held to satisfy $ph-\{QR\times(1/(1+r))\}=Pn$ (Pn being a constant representing a proper pressure in the nozzle), where ph represents a potential pressure in the main tank as viewed from a surface of an orifice plate where the nozzle of the ink jet head is formed, R represents a total flow path resistance from the main tank to the sub-tank via the ink jet head, a ratio of a flow path resistance from the main tank to the nozzle and a flow path resistance from the nozzle to the sub-tank is expressed by 1:r, and Q represents a flow rate of ink that circulates in a circulation path formed by connecting the ink jet head, the main tank and the sub-tank.

18 Claims, 10 Drawing Sheets

U.S. PATENT DOCUMENTS

| | | | |
|---|---|---|---|
| 2005/0007399 | A1 | 1/2005 | Harvey et al. |

FOREIGN PATENT DOCUMENTS

| | | |
|---|---|---|
| JP | 2000-289222 | 10/2000 |
| JP | 2000-326523 | 11/2000 |
| JP | 2005-161633 | 6/2005 |
| JP | 2006-021197 | 1/2006 |
| JP | 2006-175651 | 7/2006 |
| JP | 2006-224435 | 8/2006 |
| WO | 2006030235 | 3/2006 |
| WO | 2006064036 | 6/2006 |
| WO | 2006064040 | 6/2006 |
| WO | 2006064043 | 6/2006 |

* cited by examiner

INK JET RECORDING APPARATUS, INK SUPPLYING MECHANISM AND INK JET RECORDING METHOD

CROSS-REFERENCE TO RELATED APPLICATIONS

This application is a Continuation of application Ser. No. 11/617,246 filed Dec. 28, 2006 now abandoned, the entire contents of which is hereby incorporated by reference.

BACKGROUND OF THE INVENTION

1. Field of the Invention

The present invention relates to an ink jet recording apparatus, an ink supplying mechanism and an ink jet recording method in which ink is ejected from an ink jet head while the ink is circulated.

2. Description of the Related Art

An ink jet recording apparatus and an ink jet recording method have been known in which ink is ejected from a nozzle of an ink jet head while the ink is circulated. In such an ink jet recording apparatus, leakage of the ink from the nozzle and suction of air from the nozzle are prevented and a proper ejection droplet shape of the ink must be provided. To realize these, it is considered desirable that the pressure near the nozzle of the ink jet head should be maintained at a proper value. For example, in an ink jet recording apparatus as shown in FIG. 11, the ink tank is arranged below the head in order to realize a negative pressure near the nozzle. The head is connected to a lower ink tank part via a duct. In the case where the liquid surface in the lower ink tank part is situated below the surface of the nozzle plate by a height h, the potential pressure to the vicinity of the nozzle in the ink chamber is $-\rho gh$ (where $\rho$ is the density of the ink, and g is the acceleration of gravity). This liquid surface is opened to the atmosphere. Therefore, when the pressure loss in the ink duct is sufficiently small, the vicinity of the nozzle in the ink chamber is maintained at the negative pressure of $-\rho gh$.

However, there often is a mechanical limitation of a printing machine in supplying the ink from the position below the head as described above. For example, generally, in a serial-scan printing machine, a scanning mechanism including a belt and a slider exists near the head, and it is divided at the head into an upper part and a lower part. Also, in a fixed-head printing machine, generally, the ink jet head ejects ink downward and a print sheet moves horizontally below the head. Therefore, the printing machine is structurally divided into an upper part and a lower part by the print sheet and its feed mechanism. If ink is to be fed to the head from the ink tank situated below the head in such a printing machine, the ink duct is most likely to be long and meandering. Therefore, it is also difficult to secure the diameter of the duct.

With a narrow, long and meandering duct, the increased flow path resistance cannot be ignored. Therefore, the negative pressure in the pressure chamber near the nozzle is changed by the quantity of ejected ink affected by the flow path resistance, and it becomes difficult to maintain a proper negative pressure.

Also, a long and meandering duct complicates the structure of the printing machine and causes poor maintainability. Since the ink volume in the duct is large, waste of ink increases.

For a serial-scan low-speed printing machine, a technique is provided that includes a mechanism for generating a negative pressure, formed by a porous member, deformative bag or the like above the vicinity of the head. However, with these mechanisms, it is difficult to secure compatibility with various types of ink. Also, no idea is given of applying this technique to an ink supply system of a circulation-type head.

For a large-size printing machine or the like, a technique is provided in which a sub-tank supplied with negative-pressure air is installed above the vicinity of the head, and ink is pumped up from the main tank to the sub-tank by a pump, enabling installation of the sub-tank near the head. Therefore, the pressure loss in the duct from the sub-tank to the head can be reduced relatively easily, but no idea is given of applying this technique to a circulation-type ink supply system.

BRIEF SUMMARY OF THE INVENTION

An ink jet recording apparatus according to an embodiment of the invention includes: an ink jet head having a pressure chamber with a nozzle, an upstream port and a downstream port; a main tank connected to the ink jet head via the upstream port and capable of holding ink therein; and a sub-tank connected to the ink jet head via the downstream port and capable of storing ink therein. At least when printing by ejecting ink from the nozzle, the relation between ph, r, R and Q is held to satisfy $ph-\{QR\times(1/(1+r))\}=Pn$ (Pn being a constant representing a proper pressure in the nozzle), where ph represents a potential pressure in the main tank as viewed from the nozzle of the ink jet head, R represents a total flow path resistance from the main tank to the sub-tank via the ink jet head, a ratio of a flow path resistance from the main tank to the nozzle and a flow path resistance from the nozzle to the sub-tank is expressed by 1:r, and Q represents a flow rate of ink that circulates in a circulation path formed by connecting the ink jet head, the main tank and the sub-tank.

In an ink jet recording method according to an embodiment of the invention, in a circulation path formed by connecting an ink jet head having a pressure chamber with a nozzle and an upstream port and a downstream port, a main tank connected to the ink jet head via the upstream port and capable of holding ink therein, and a sub-tank connected to the ink jet head via the downstream port and capable of storing ink therein, at least when printing by ejecting ink from the nozzle, the ink is circulated in a state where the relation between ph, r, R and Q is held to satisfy $ph-\{QR\times(1/(1+r))\}=Pn$ (Pn being a constant representing a proper pressure in the nozzle), where ph represents a potential pressure in the main tank as viewed from the nozzle of the ink jet head, R represents a total flow path resistance from the main tank to the sub-tank via the ink jet head, a ratio of a flow path resistance from the main tank to the nozzle and a flow path resistance from the nozzle to the sub-tank is expressed by 1:r, and Q represents a flow rate of a circulation pump.

Objects and advantages of the invention will become apparent from the description which follows, or may be learned by practice of the invention.

BRIEF DESCRIPTION OF THE DRAWINGS

The accompanying drawings illustrate embodiments of the invention, and together with the general description given above and the detailed description given below, serve to explain the principles of the invention.

DETAILED DESCRIPTION OF THE INVENTION

First Embodiment

Figure 1:
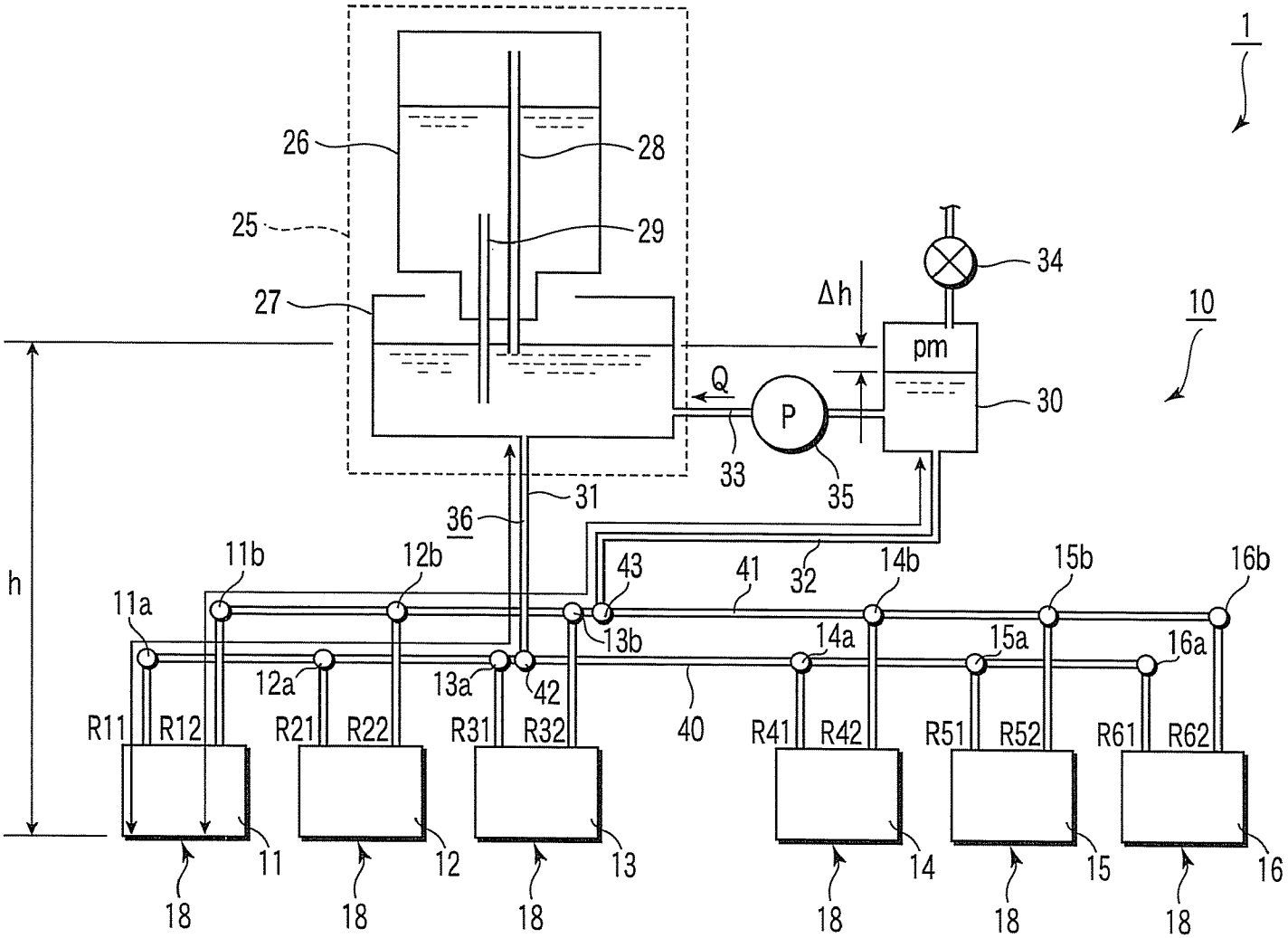
FIG. 1 is a view schematically showing an overall configuration of an ink jet recording apparatus in a first embodiment of the invention.

Hereinafter, an ink jet recording apparatus and ink jet recording method according to an embodiment of the invention will be described with reference to FIG. 1 to FIG. 3. In the drawings, the configuration is schematically shown in an enlarged or reduced manner, or with some parts omitted. An ink jet recording apparatus 1 is configured to form an image by ejecting ink onto a recording medium, not shown, from nozzles of ink jet heads 11 to 16 while circulating the ink. It has an ink supplying mechanism 10. This ink supplying mechanism 10 has plural (in this case, six) ink jet heads 11 to 16, a main tank 25 as an ink supply tank, a negative-pressure tank 30 for storing ink, first, second and third ducts 31 to 33 that connect these and form an ink circulation path, a circulation pump 35 as an ink feed mechanism to circulate ink, and so on.

Figure 2:
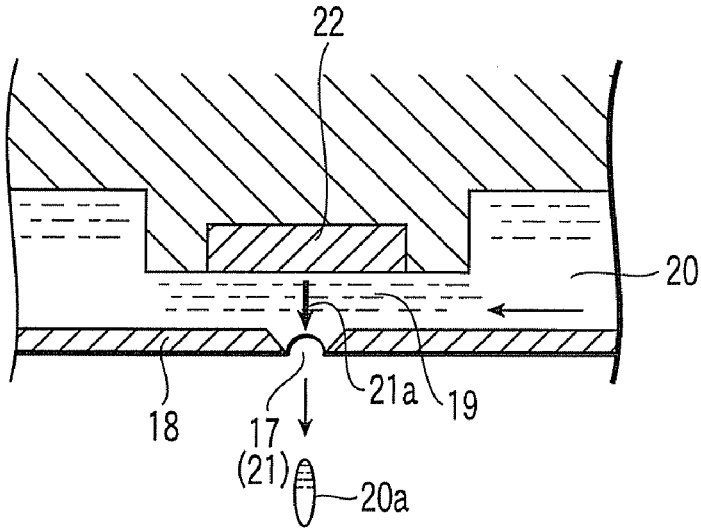
FIG. 2 is a partial sectional view showing a structure around a nozzle of an ink jet head in the embodiment.

Each of the ink jet heads 11 to 16 shown in FIG. 2 has an orifice plate 18 having a nozzle 17. A pressure chamber 19 facing the nozzle 17 is formed on the rear side of the orifice plate 18. Ink 20 circulates via this pressure chamber 19. The pressure chamber 19 is formed to be narrower than the circulation path connected to the ducts 31, 32. An actuator 22 is provided in the pressure chamber 19 formed on the opposite side to the nozzle 17 in FIG. 2. As this actuator 22 is driven in the pressure chamber 19, an ink droplet 20*a* is ejected from the nozzle. As the actuator 22, for example, an actuator that directly or indirectly deforms the pressure chamber by using a piezoelectric device like PZT, an actuator that electrostatically drives a diaphragm, or an actuator that directly and electrostatically moves the ink can be used, but the actuator is not limited to these. The respective ink jet heads 11 to 16 have their respective upstream ports 11*a* to 16*a* and downstream ports 11*b* to 16*b*. The upstream ports 11*a* to 16*a* of the ink jet heads 11 to 16 are connected to the main tank 25 via the first duct 31. The downstream ports 11*b* to 16*b* are connected to the negative-pressure tank via the second duct 32. In the ink jet heads 11 to 16 configured in this manner, the ink 20 circulates via the pressure chamber 19, for example, from right to left as indicated by an arrow in FIG. 2.

The main tank 25 is arranged above the ink jet heads 11 to 16 and has the function of an ink supply source for supplying the ink, as shown in FIG. 1. The main tank 25 has an upper tank 26 and a lower tank 27. The liquid surface in the lower tank 27 is opened to the atmosphere. The upper tank 26 is a replaceable bottle. When the upper tank 26 has run out of its ink, the user replaces the upper tank 26 with a new bottle filled with ink. The upper tank 26 and the lower tank 27 are connected to each other via a ventilation pipe 28 and an ink supply pipe 29. When the ink in the ink jet heads 11 to 16 is consumed, the liquid surface in the lower tank 27 is accordingly lowered and the lower edge of the ventilation pipe 28 is away from the liquid surface in the ink tank. At this point, air is fed into the upper tank 26 via the ventilation pipe 28 with its lower edge exposed. As the ink pushed out by this air in the upper tank 26 drops into the lower tank 27 through the ink supply pipe 29, the liquid surface in the lower tank 27 rises. As this rise causes the liquid surface in the lower tank 27 to reach the lower edge of the ventilation pipe 28, the ventilation pipe 28 is closed. Therefore, the entry of air into the upper tank 26 stops and the supply of the ink is stopped. Thus, the ink is supplied while the liquid surface in the lower tank 27 is controlled.

When the setting range of proper pressure near the nozzles 17 in the ink chambers of the ink jet heads, that is, in the pressure chambers 19, has a certain margin, since the height of the liquid surface need not be strict, a shallow container with a large sectional area can be used as the main tank 25 and changes in the height of the water surface with respect to changes in the volume can be restrained. In that case, the user may directly supply the ink to the main tank 25 when the amount of the ink in the main tank 25 is reduced, and the configuration with the replaceable bottle can be omitted.

The main tank is connected to the upstream ports 11*a* to 16*a* of the ink jet heads 11 to 16 via the first duct 31. The main tank is arranged immediately above the ink jet heads 11 to 16 and near the center in order to make the first duct 31 as short as possible.

The negative-pressure tank 30 as the sub-tank is an ink tank having an ink entrance 30*a* and an ink exit 30*b*. It stores the ink and has the function of a pressure source that generates energy P per unit volume, with reference to the surface of the orifice plate 18. The negative-pressure tank 30 is arranged above the ink jet heads 11 to 16. The ink entrance 30*a* is connected to the downstream ports 11*b* to 16*b* of the ink jet heads 11 to 16 via the second duct 32. The ink exit 30*b* is connected to the main tank 25 via the third duct 33 having the circulation pump 35. The negative-pressure tank 30 has a valve 34 above it. Opening and closing of this valve 34 enables selective opening and closing of the liquid surface in the negative-pressure tank 30 to the atmosphere.

The insides of these main tank 25, negative-pressure tank 30, first duct, 31, second duct 32, third duct 33 and pressure chamber 19 are connected to each other and thus form a circulation path 36.

The circulation pump 35 is provided in the third duct 33 and has the function of circulating the ink 20.

Here it is assumed that the ejection flow rate is sufficiently smaller than the circulation flow rate. In this case, the value of the pressure loss in the ink supplying mechanism 10 and the ink jet heads 11 to 16 will be more affected by the circulation flow rate than by the ejection flow rate. The dynamic pressure due to circulating flows near the nozzles 17 at the lower edges of the ink jet heads 11 to 16 is generally sufficiently small and can be ignored. Also, in such an ink supplying mechanism for the ink jet heads 11 to 16, the Reynolds number is usually sufficiently small and the influence of turbulence can be ignored.

In this embodiment, as shown in FIG. 1, the flow path resistances from the main tank 25 to the nozzles 17 at the lower edges of the ink jet heads 11 to 16 via the first duct 31, the upstream ports 11*a* to 16*a* and ink paths (not shown) within the ink jet heads 11 to 16 are expressed as R11 to R61. Also, the flow path resistances from the nozzles 17 to the negative-pressure tank 30 via the ink paths within the ink jet heads 11 to 16 and the downstream ports 11*b* to 16*b* are expressed as R12 to R62. Arrows are shown only for R11 and R12 corresponding to the ink jet head 11, but the same applies to the other ink jet heads 12 to 16. In this case, the ratios r of the upstream flow path resistance and the downstream flow path resistance as viewed from the nozzles 17 of the ink jet heads 11 to 16 are made equal to realize R11:R12=R21:R22=R31:R32=R41:R42=R51:R52=R61:R62=1:r. Here, in the example as shown in FIG. 1, R11 to R61 and R12 to R62 are actually not independent and separate for the respective heads and share a common duct. The common duct is considered to be apportioned for each head. The method for apportionment will be described later.

Additionally, the value of flow path resistance is expressed as R when a network combining the flow path resistances R11 to R61 and R12 to R62, including the ducts 31 to 33 and the ink jet heads 11 to 16, is viewed from the two points of the main tank 25 and the negative-pressure tank 30.

Since the liquid surface in the main tank 25 is situated at a position higher by h than the surfaces of the orifice plates 18 of the ink jet heads 11 to 16, the ink in the main tank 25 is considered to have a potential pressure of ph=ρgh if the height of the surfaces of the orifice plates 18 is used as a reference.

In this ink supplying mechanism 10, in a state where no ink exists in the circulation path 36, the valve 34 of the negative-pressure tank 30 is opened, the circulation pump 35 is stopped and opened, and a bottle filled with ink is attached to the upper tank 26 of the main tank 25 initially.

Thus, the ink 20 flows down to the lower tank 27 until a predetermined liquid surface height is reached. In this case, by the potential pressure, the ink 20 is caused to flow into the upper ports 11*a* to 16*a* of the ink jet heads 11 to 16 via the first duct 31. Moreover, the ink 20 flows backward through the circulation pump 35 and flows into the negative-pressure tank 30 until the liquid surface height in the negative-pressure tank 30 becomes equal to the liquid surface height in the main tank 25. The ink also flows into the downstream ports 11*b* to 16*b* of the ink jet heads 11 to 16 via the second duct 32 on the downstream. Thus, the ink jet heads 11 to 16 are filled with the ink.

In this case, if the periphery of each of the nozzles 17 is dry, a meniscus 21 of the ink 20 is formed in the nozzle 17. If this meniscus pressure 21*a* is larger than ρgh, the ink 20 does not drip from the nozzle 17.

After it is filled with the ink 20, the valve 34 of the negative-pressure tank 30 is closed and the circulation pump 35 is driven at a flow rate Q. Here, the relation of ph, R and rQ is set to meet ph−{QR×(1/(1+r))}=Pn . . . (1), where Pn is a constant representing the meniscus pressure in the nozzle. Here, the constant Pn is set to −1 kPa, and the flow rate Q is set to meet the above equation (1). When ph−{QR×(1/(1+r))}=−1 kPa . . . (2) is satisfied, the negative meniscus pressure 21*a* of −1 kPa is applied to the nozzle 17 and the meniscus 21 of an appropriate concave shape is formed.

In this case, as shown in FIG. 1, the liquid surface in the negative-pressure tank 30 is lowered by Δh and the internal pressure becomes pm. The relation of QR with Δh and pm is expressed by QR=ρgΔh−pm. However, the sectional area of the liquid surface in the main tank 25 is sufficiently large and the change in the liquid surface height in the main tank 25 due to the circulation can be ignored.

Figure 3:
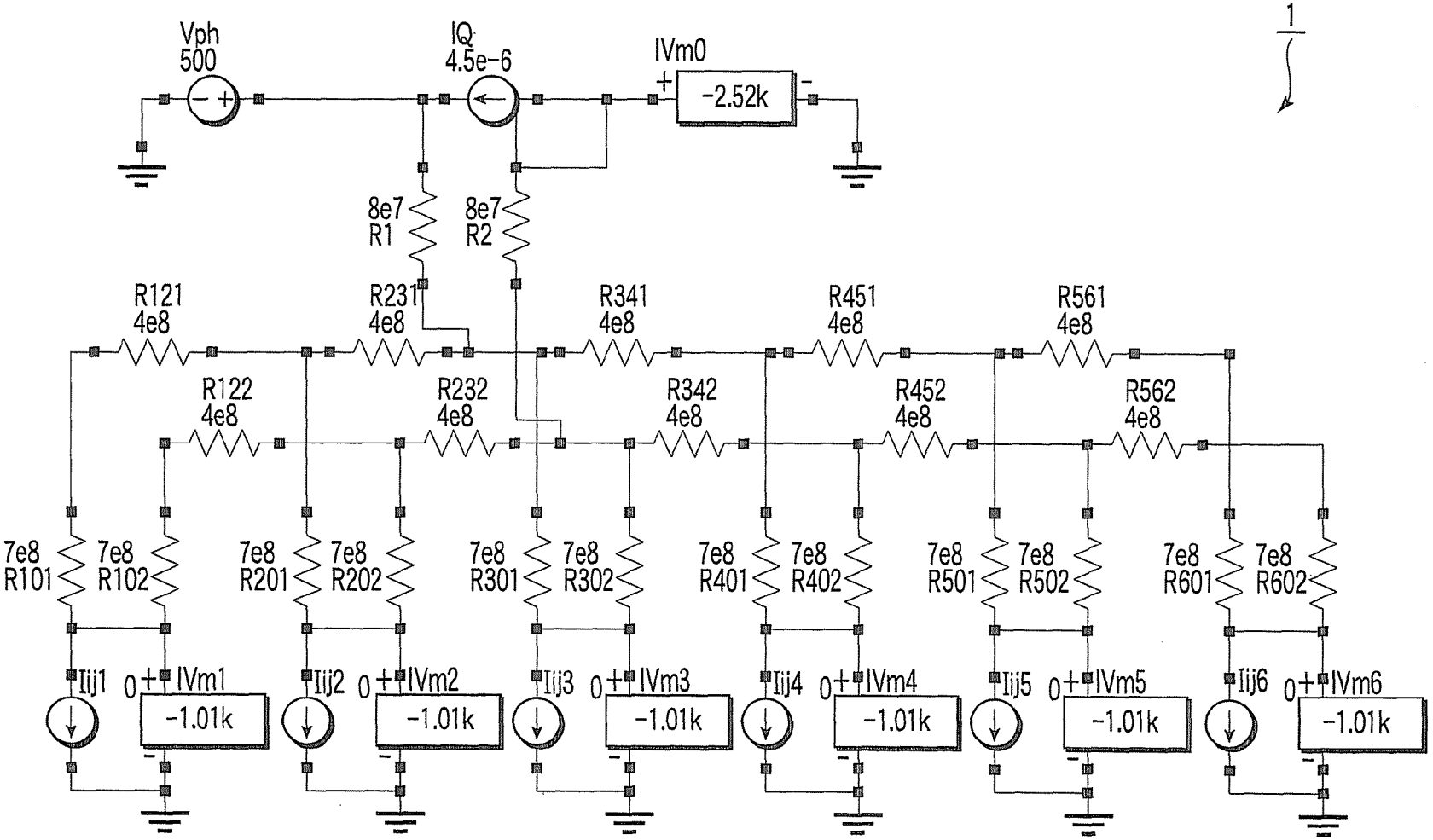
FIG. 3 is an equivalent circuit diagram of an ink supplying mechanism in the embodiment.

FIG. 3 is an equivalent circuit diagram where r=1 holds. Here, oil ink having a viscosity of 10 mPa*s and a specific gravity of 0.85 is used. The ink jet heads 11 to 16 have 636 nozzles 17. Each nozzle 17 can be driven at a frequency of 6.24 kHz and ejects 42 pL of ink at its maximum. Therefore, the flow rate of the ink ejected from the nozzles 17 of one of the ink jet heads 11 to 16 is $1.67\times10^{-7}$ $m^3/s$ at its maximum.

Also, both the flow path resistances R101 to R601 from the upstream ports 11*a* to 16*a* to the nozzles 17 in the ink jet heads 11 to 16, and the flow path resistances R102 to R602 from the nozzles 17 to the downstream ports 11*b* to 16*b*, are $7\times10^8$ $Pa*s/m^3$.

Between each upstream ports and between each downstream ports of the neighboring ink jet heads 11 to 16 are connected by a fourth duct 40 and a fifth duct 41 having a size of 3 mm (diameter) by 80 mm. Each of their flow path resistances R121, R231, R341, R451, R561, R122, R232, R342, R452, R562 is $4\times10^8$ $Pa*s/m^3$.

The first duct 31 is branched at a branch point 42 arranged near the upstream port 13*a* of the ink jet head 13. The first duct 31 is formed by a tube with a size of 4 mm (diameter) by 50 mm, connected to the main tank 25. The flow path resistance R1 at this part is $8\times10^7$ $Pa*s/m^3$.

Also, the second duct 32 is branched at a branch point 43 arranged near the downstream port 13*b* of the ink jet head 13. The second duct 32 is formed by a tube with a size of 4 mm (diameter) by 50 mm, connected to the negative-pressure tank 30. The flow path resistance R2 at this part is $8\times10^7$ $Pa*s/m^3$.

The liquid surface height in the main tank 25 is opened to the atmosphere at a position 60 mm higher than the surfaces of the orifice plates 18 of the ink jet heads 11 to 16, and the liquid surface is controlled. The potential pressure ph caused by the difference between the liquid surface in this main tank 25 and the water head on the surface of the nozzle 17 is $0.85\times9.8$ $m/s^2\times60$ mm=500 Pa, where the acceleration of gravity g is 9.8 $m/s^2$.

In this ink supplying mechanism 10, the upstream flow path resistance in the area from the surface of the orifice plate 18 to the main tank 25 and the downstream flow path resistance in the area from the nozzle 17 to the negative-pressure tank 30 are equal, and the ratio r of the flow path resistances is 1.

If the flow path resistance R is calculated where this ink supplying mechanism network is viewed from the two points of the main tank 25 and the negative-pressure tank 30, it is $R=6.7\times10^8$ $Pa*s/m^3$. When ph=500, r=1 and $R=6.7\times10^8$ are substituted in the equation (1), it is expressed as $500-\{Q\times6.7\times10^8\times(1/2)\}=-1000$ and Q is expressed as $Q=1500/(6.7\times10^8\times(1/2))=4.5\times10^{-6}$. That is, if the circulation pump 35 is driven at a flow rate of $4.5\times10^{-6}$ ($m^3/s$), the meniscus pressure in the nozzle 17 is −1000 Pa.

In FIG. 3, Vph is the potential pressure of the liquid surface in the main tank 25 as viewed from the height of the surface of the orifice plate 18, and lQ is the flow rate in the circulation pump 35. lVm0 is the internal pressure of the negative-pressure tank 30 and it is −2.5 kPa. lVm1 to lVm6 are meniscus pressures of the respective nozzles in the ink jet heads 11 to 16 and they are −1 kPa.

Iij1 to Iij6 represent the flow rates of the ink 20 ejected from the respective nozzles 17 of the ink jet heads 11 to 16. The numerical values in FIG. 3 represent values in the case where no ink is ejected and Iij1 to Iij6 are 0.

From the respective nozzles 17 of the ink jet heads 11 to 16, the ink 20 is ejected at $1.67\times10^{-7}$ $m^3/s$ at its maximum. If this maximum value is substituted in Iij1 to Iij6 and calculation is done by using Spice, the meniscus pressures lVm1 to lVm6 in the respective nozzles 17 of the ink jet heads 11 to 16 change to −1.38 kPa, −1.34 kPa, −1.27 kPa, −1.38 kPa, −1.44 kPa, and −1.47 kPa. In this regard, the numerical values of the pressures are average values excluding high-frequency components generated by the actuator for the ink ejecting operation.

Here, there is neither leakage of the ink 20 from the nozzles 17 nor suction of air from the nozzles 17, and an appropriate ejection droplet shape can be provided. A proper range of meniscus pressure that enables the meniscus to be formed is, for example, $0 \geqq Pn \geqq -3$ kpa, which is slightly lower than the atmospheric pressure. The meniscus pressures lVm1 to lVm6 in the nozzles 17 have only a small difference from those in the case of Iij1 to Iij6=0, and each of them is within the proper pressure range.

In the ink supplying mechanism according to this embodiment, the pressure near the nozzle 17 in the ink chamber, that is, the pressure in the pressure chamber 19, can be made a proper pressure with a simple configuration (however, it is an average value excluding high-frequency components generated by the actuator for the ink ejecting operation). That is, by properly adjusting the relation between the flow path resistance, the ratio of flow path resistance, and the circulation flow rate, it is possible to secure a proper negative meniscus pressure in the nozzle 17 even when one of these elements has a restraint. Moreover, since the ink supplying mechanism can be configured above the ink jet heads 11 to 16, the structure of the ink jet recording apparatus 1 itself can be simplified. That is, the ducts 31 to 33 and the like can be short. Thus, waste of ink can be restrained. Moreover, since the viscosity of the ink has less influence than in the case of using a porous member or deformative bag, it is possible to secure compatibility with the ink.

The first duct 31 between the main tank 25 and the ink jet heads 11 to 16, and the second duct 32 between the negative-pressure tank 30 and the ink jet heads 11 to 16, which determine the meniscus pressure, can be easily set to be large in diameter and short in length. Therefore, a printing apparatus with stable meniscus pressure can be provided.

Since the meniscus pressure is stable, the ink ejection state is stabilized. Therefore, a highly reliable ink jet recording apparatus with few changes in density can be provided. Also, since all the ducts are situated near the heads, they can be set to be large in diameter and short in length, and the pressure necessary for providing a predetermined circulation flow rate can be set to be low. As the pressure in each part is low, the configuration of the ink jet recording apparatus is simplified.

Also, the first duct 31 between the main tank 25 and the ink jet heads 11 to 16, and the second duct 32 between the negative-pressure tank 30 and the ink jet heads 11 to 16, which determine the meniscus pressure, can be reduced in volume, and therefore waste of ink can be prevented.

According to the invention, it is possible to complete all the principal components that form the ink supplying mechanism 10, in the section above the ink jet heads 11 to 16. Therefore, an ink jet recording apparatus with a simple structure that can be easily maintained can be provided.

Second Embodiment

Figure 4:
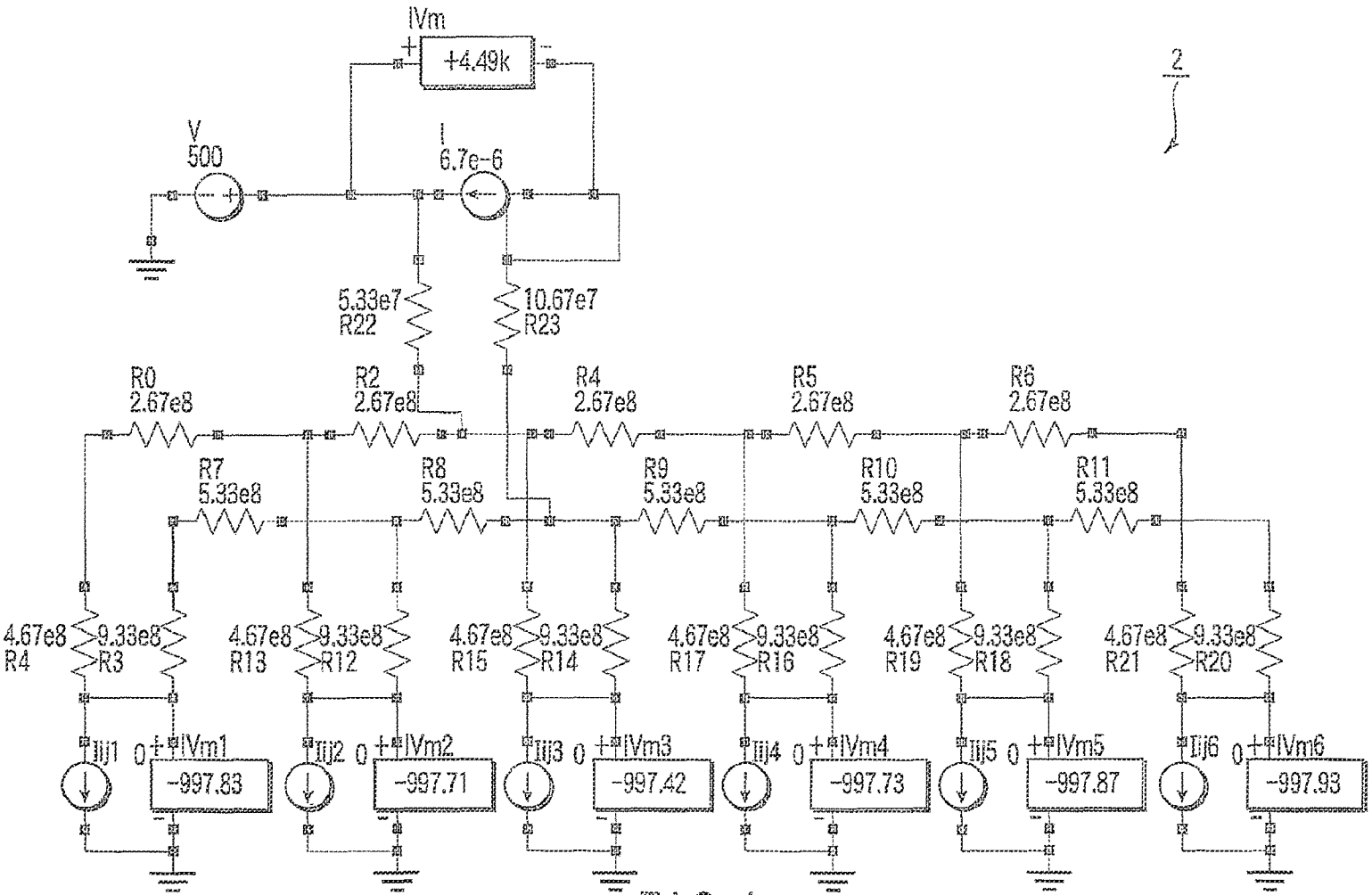
FIG. 4 is an equivalent circuit diagram of an ink supplying mechanism in a second embodiment of the invention.

Next, an ink jet recording apparatus and an ink jet recording method according to a second embodiment of the invention will be described with reference to FIG. 4. The configuration is similar to that of the first embodiment except for the value of the ratio r of flow path resistance, and therefore will not be described further.

In an ink jet recording apparatus 2 according to this embodiment, the flow path resistance in each part on the upstream of the nozzle 17 is set to be smaller than in the first embodiment, and the flow path resistance in each part on the downstream is set to be larger than in the first embodiment. The value of the ratio r of flow path resistance is 2. If the flow path resistance R as viewed from the two points of the main tank 25 and the negative-pressure tank 30 is the same as in the first embodiment, the circulation flow rate Q that can maintain the pressure in the nozzle 17 at the same proper value in the first embodiment is $Q=1500/(6.7\times10^{8}\times(1/(1+2)))=6.7\times10^{-6}$ ($m^3/s$), in accordance with the equations (1) and (2). In this case, the equivalent circuit and the pressure in each part are as shown in FIG. 4.

When the ink is ejected at $1.67\times10^{-7}$ $m^3/s$ from the respective nozzles 17 of the ink jet heads 11 to 16, if this maximum value is substituted in Iij1 to Iij6 to calculate the equation (1) by using Spice, the meniscus pressures lVm1 to lVm6 in the respective nozzles 17 of the ink jet heads 11 to 16 are −1.25 kPa, −1.22 kPa, −1.16 kPa, −1.25 kPa, −1.31 kPa, and −1.34 kPa.

However, the numerical values of the pressures are average values excluding high-frequency components generated by the actuator for the ink ejecting operation.

The meniscus pressures lVm1 to lVm6 in the nozzles 17 have a smaller difference from those in the case of Iij1 to Iij6=0, than in r=1 of the first embodiment, and each of them is within the proper pressure range.

Also in this embodiment, the advantages similar to those of the first embodiment can be achieved. This embodiment is more preferable than the first embodiment in that there is less change in the meniscus pressure in the nozzles at the time of ejecting the ink. That is, the pressure in the pressure chamber near the nozzles 17 can constantly be made a proper pressure with a simple configuration (however, it is an average value excluding high-frequency components generated by the actuator for the ink ejecting operation).

Moreover, the ink jet recording apparatus 2 according to this embodiment is advantageous in the case where the liquid surface height in the main tank 25 is stable, because the meniscus pressure 21*a* in each nozzle 17 is more strongly affected by the pressure in the main tank 25 and less affected by the negative-pressure tank 30.

Third Embodiment

Figure 5:
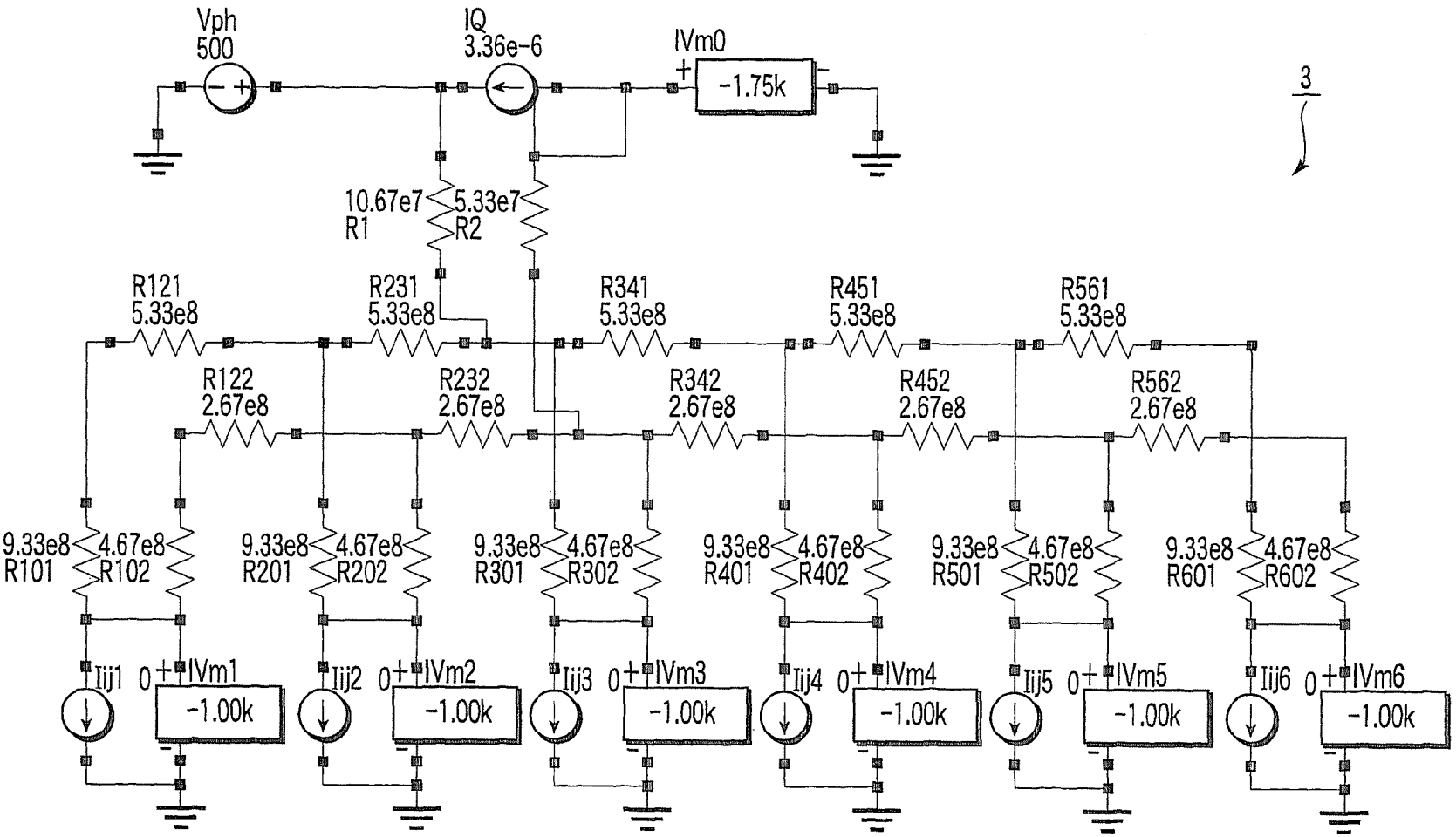
FIG. 5 is an equivalent circuit diagram of an ink supplying mechanism in a third embodiment of the invention.

Next, an ink jet recording apparatus and an ink jet recording method according to a third embodiment of the invention will be described with reference to FIG. 5. The configuration is similar to that of the first embodiment except for the value of the ratio r of flow path resistance, and therefore will not be described further.

In an ink jet recording apparatus 3 according to this embodiment, the flow path resistance in each part on the upstream of the nozzle 17 is set to be larger than in the first embodiment, and the flow path resistance in each part on the downstream is set to be smaller than in the first embodiment. The value of the ratio r of flow path resistance is 0.5. Here, a case where the flow path resistance R as viewed from the two points of the main tank 25 and the negative-pressure tank 30 is the same as in the first embodiment will be described. The circulation flow rate Q that can maintain the nozzle pressure at the same proper value in the first embodiment is $Q=1500/(6.7\times10^{8}\times(1/(1+0.5)))=3.36\times10^{-6}$ ($m^3/s$), in accordance with the equations (1) and (2). In this case, the equivalent circuit and the pressure in each part are as shown in FIG. 5. The pressure on the nozzle surface when no ejection is made from any nozzle is −1 kPa, which is the same as in the first embodiment and the second embodiment.

When the ink is ejected at $1.67\times10^{-7}$ $m^3/s$ from the respective nozzles of the ink jet heads 11 to 16, if this maximum value is substituted in Iij1 to Iij6 to carry out calculation using Spice, the pressures lVm1 to lVm6 on the surfaces of the respective nozzles of the ink jet heads 11 to 16 change to −1.48 kPa, −1.45 kPa, −1.39 kPa, −1.48 kPa, −1.54 kPa, and −1.57 kPa.

However, the numerical values of the pressures are average values excluding high-frequency components generated by the actuator for the ink ejecting operation.

These pressures lVm1 to lVm6 on the nozzle surfaces have a slightly larger difference from those in the case of Iij1 to Iij6=0, than in the first embodiment, but each of them is within the proper pressure range and within the allowable range.

Also in this embodiment, the advantages similar to those of the first embodiment can be achieved. That is, the pressure in the pressure chamber 19 near the nozzles 17 can constantly be made a proper pressure with a simple configuration and regardless of the circulation flow rate of the ink (however, it is an average value excluding high-frequency components generated by the actuator for the ink ejecting operation).

Fourth Embodiment

Next, an ink jet recording apparatus and an ink jet recording method according to a fourth embodiment of the invention will be described with reference to FIG. 6. The configuration is similar to that of the first embodiment except for the provision of caps 11*c* to 16*c*, and therefore will not be described further.

Figure 6:
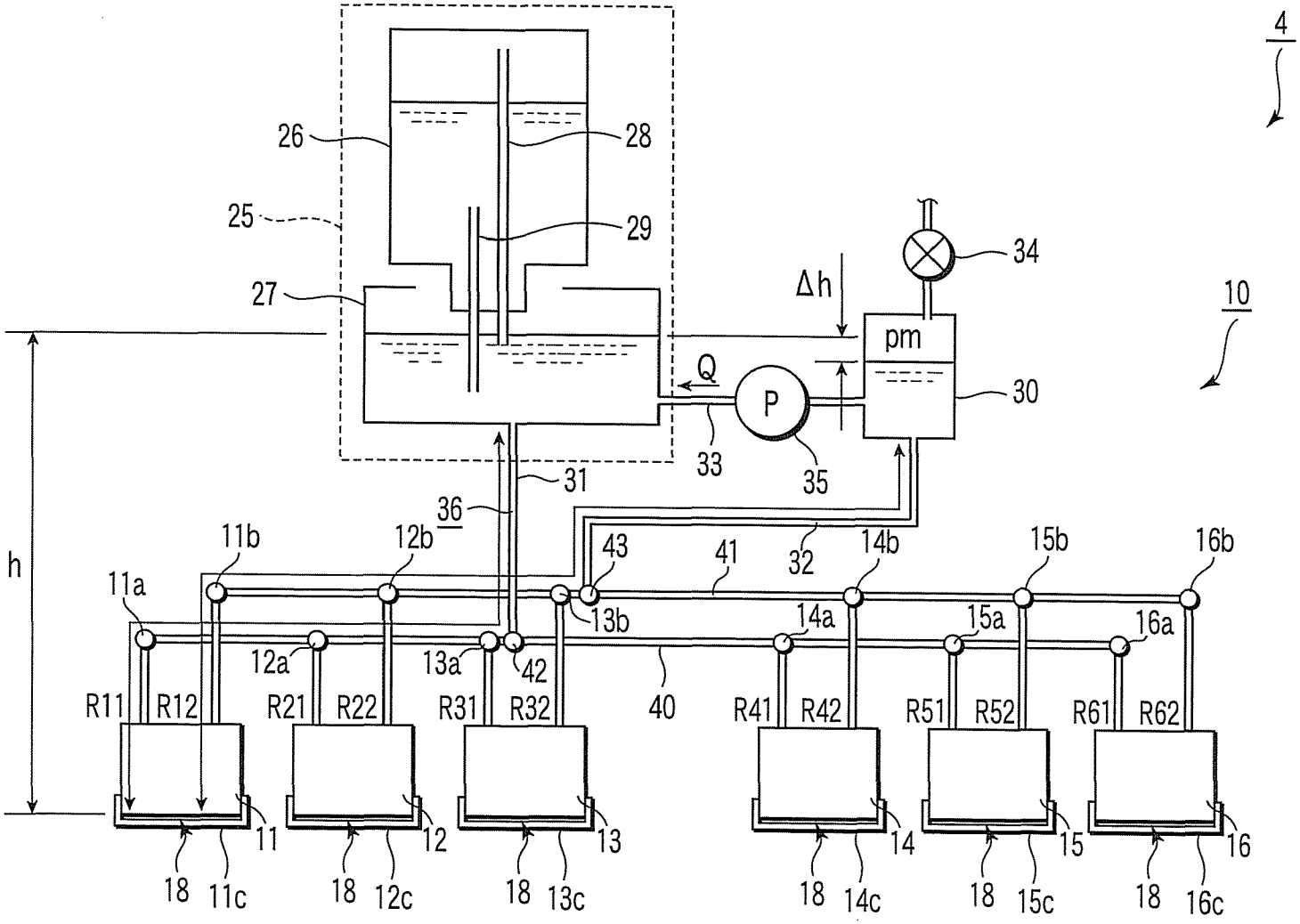
FIG. 6 is a view schematically showing an overall configuration of an ink jet recording apparatus in a fourth embodiment of the invention.

In an ink jet recording apparatus 4 according to this embodiment, attachable and removable caps 11*c* to 16*c* are provided on the surfaces of the nozzles 17 of the ink jet heads 11 to 16, as shown in FIG. 6. If the peripheries of the nozzles 17 are wet when the ink jet heads 11 to 16 are filled with the ink, no meniscuses are formed and the ink drips off the nozzles 17. In this embodiment, the ink dripped off the nozzles 17 is collected as waste ink, and the nozzles 17 are immediately closed by the caps 11*c* to 16*c* on completion of the filling. Thus, when the ink in the main tank 25 flows into the caps 11*c* to 16*c* from the nozzles 17, the internal pressures in the caps 11*c* to 16*c* rise and thus stop the flow. Therefore, the ink in the main tank 25 is prevented from entirely flowing down.

Also, there may be a case where initial ink filling is not completed and bubbles remain in the ink jet heads 11 to 16, or a case where air is sucked in from the nozzles 17 for a certain reason and the air in the ink jet heads 11 to 16 is sent to the negative-pressure tank 30 via the second duct 32 on the downstream, thus lowering the liquid surface in the negative-pressure tank 30. Even such cases can be dealt with by closing the nozzles with the caps 11*c* to 16*c*, stopping and opening the circulation pump 35 again, opening the valve 34 of the negative-pressure tank 30 to equalize the liquid surface in the negative-pressure tank 30 with the liquid surface in the main tank 25, then closing the valve 34, and restarting the circulation pump 35.

Figure 7:
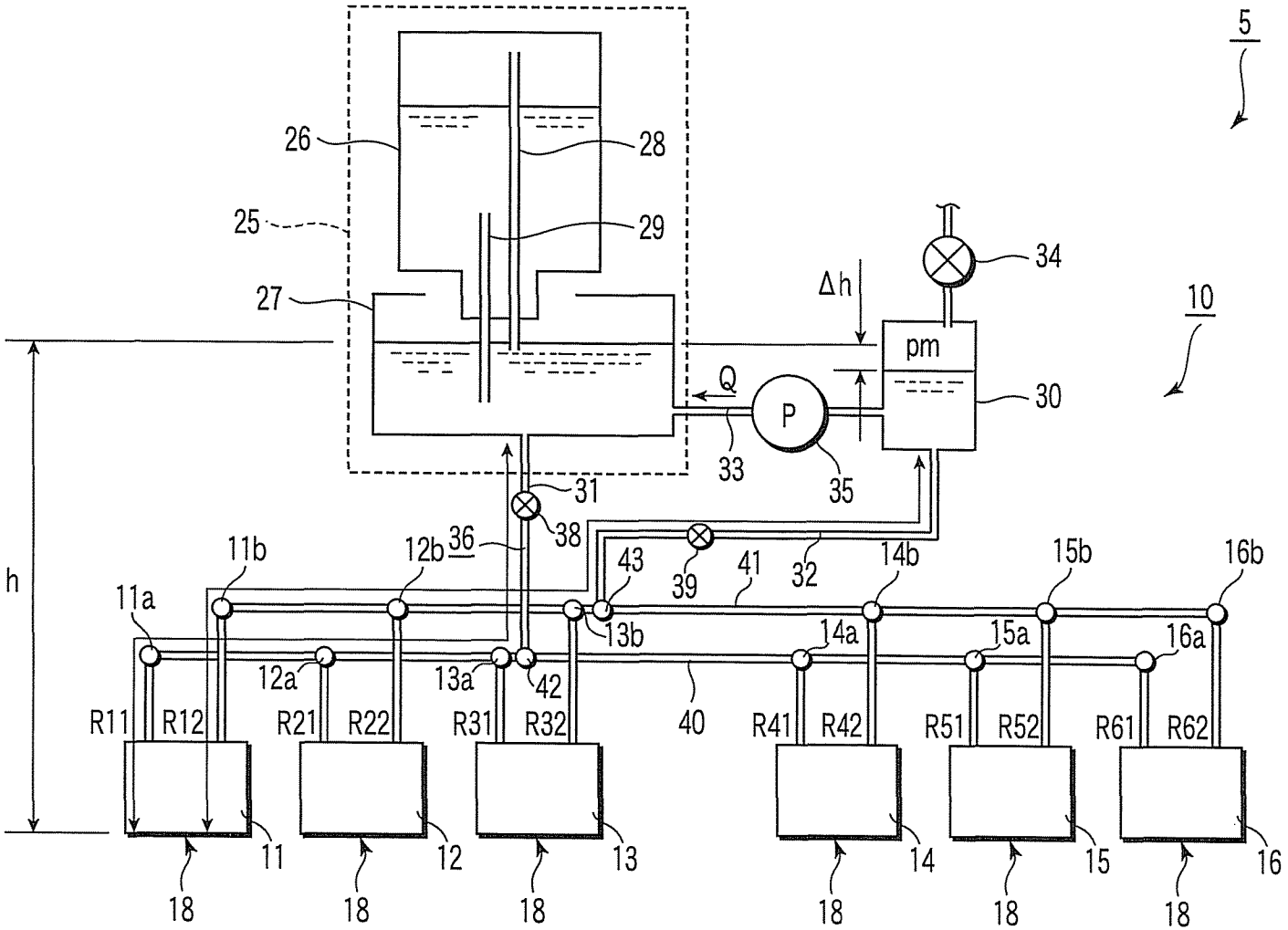
FIG. 7 is a view schematically showing an overall configuration of an ink jet recording apparatus in a modification of the fourth embodiment of the invention.

Moreover, valves 38 and 39 capable of opening and closing can be provided in the circulation paths as in an ink jet recording apparatus 5 shown in FIG. 7. In this case, as the valves 38 and 39 are closed when the circulation is stopped, the ink can be prevented from entirely flowing down from the nozzles.

The present invention is not limited to the above embodiments, and it is a matter of course that, when carrying out the invention, various changes can be made with respect to the components of the invention including specific shapes of the component members without departing from the scope of the invention. For example, in the above embodiments, the case where the nozzles 17 are situated at intermediate parts of the circulation path in the ink jet heads 11 to 16 is described. However, the invention is not limited to this. For example, the nozzles 17 and the circulation paths may be away from each other and connected by flow paths. In this case, if the pressures generated in the flow paths connecting the nozzles with the circulation paths are small, it can be considered that the connecting points between the flow paths and the circulation paths substantially have the meniscus pressures of the nozzles. Moreover, even in the case where the circulation paths are situated outside of the ink jet heads 11 to 16 and the circulation paths and the ink jet heads 11 to 16 are connected to each other by flow paths, the invention can be applied if the difference between the pressure at the connecting points between the circulation paths and the ink jet heads 11 to 16, and the pressure near the nozzles 17 (pressure chambers 19), can be regarded as being small.

In the above embodiments, the case where six ink jet heads are provided is described. However, the invention is not limited to this.

Figure 8:
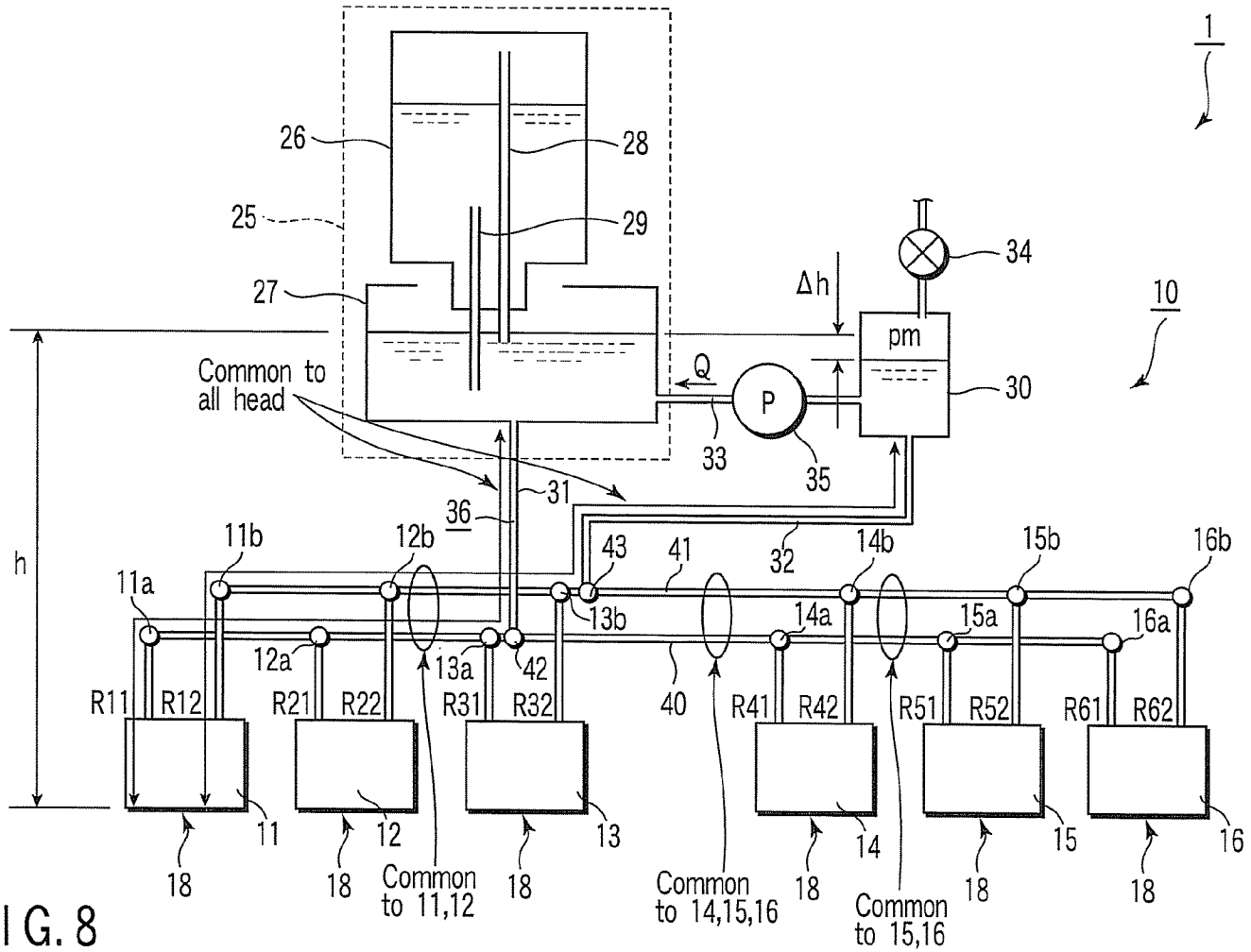
FIG. 8 is a view for explaining a method for apportioning flow path resistance according to the first embodiment of the invention.

Next, the method for apportioning the flow path resistance in the common ducts will be described. As shown in FIG. 8, in the case where the ducts are not separated for each head and have branch points to the ducts common to the plural heads, it can be considered that the common ducts are apportioned at the same proportion as the ratio of flow path resistance of the respective branch destinations. Therefore, the common ducts are apportioned as parallel resistances having the same proportion as the ratio of flow path resistance of the respective branch destinations, and the flow path resistance for each head is calculated.

Figure 9:
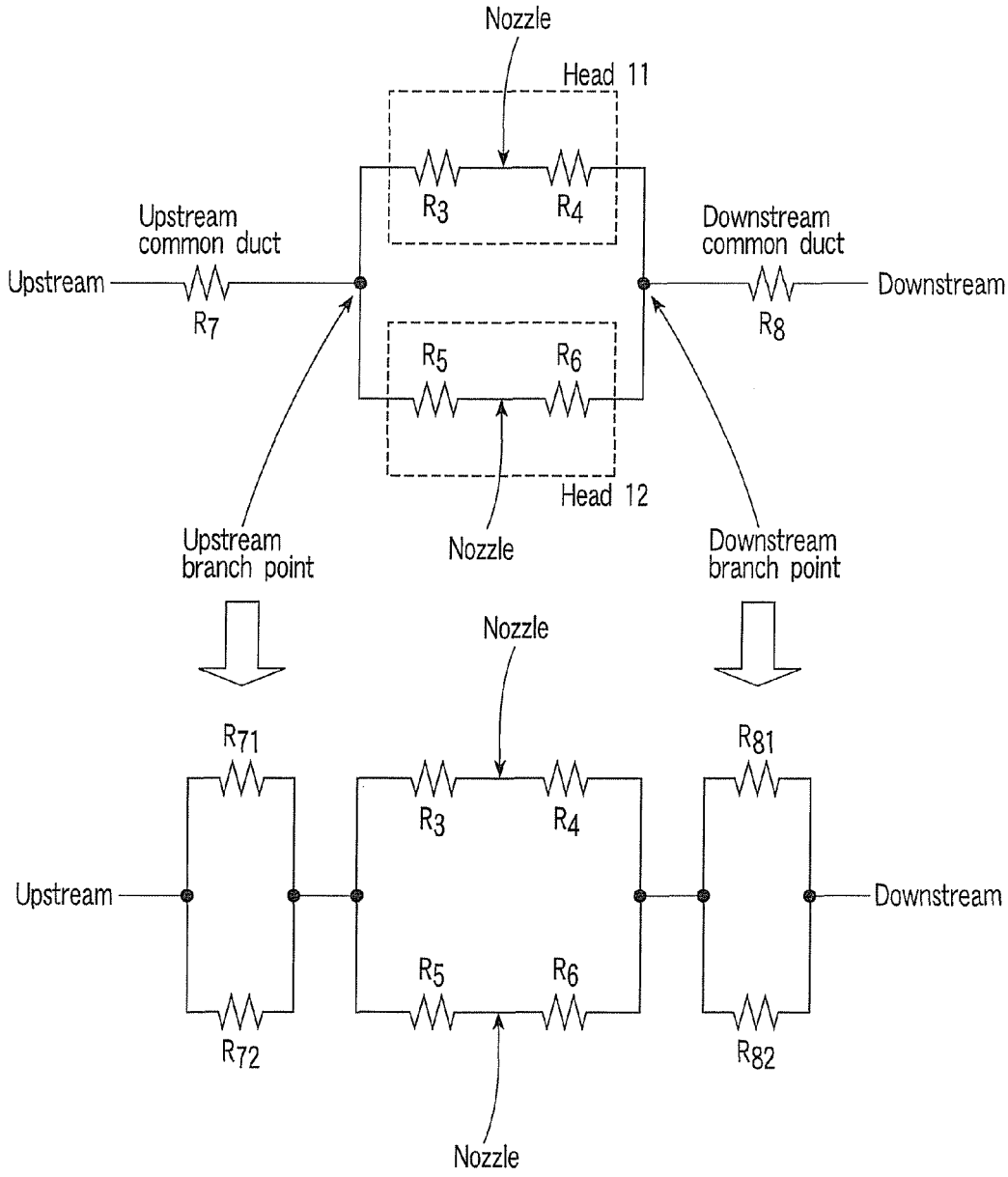
FIG. 9 is a partial equivalent circuit diagram of flow path resistance according to the first embodiment of the invention.
Figure 11:
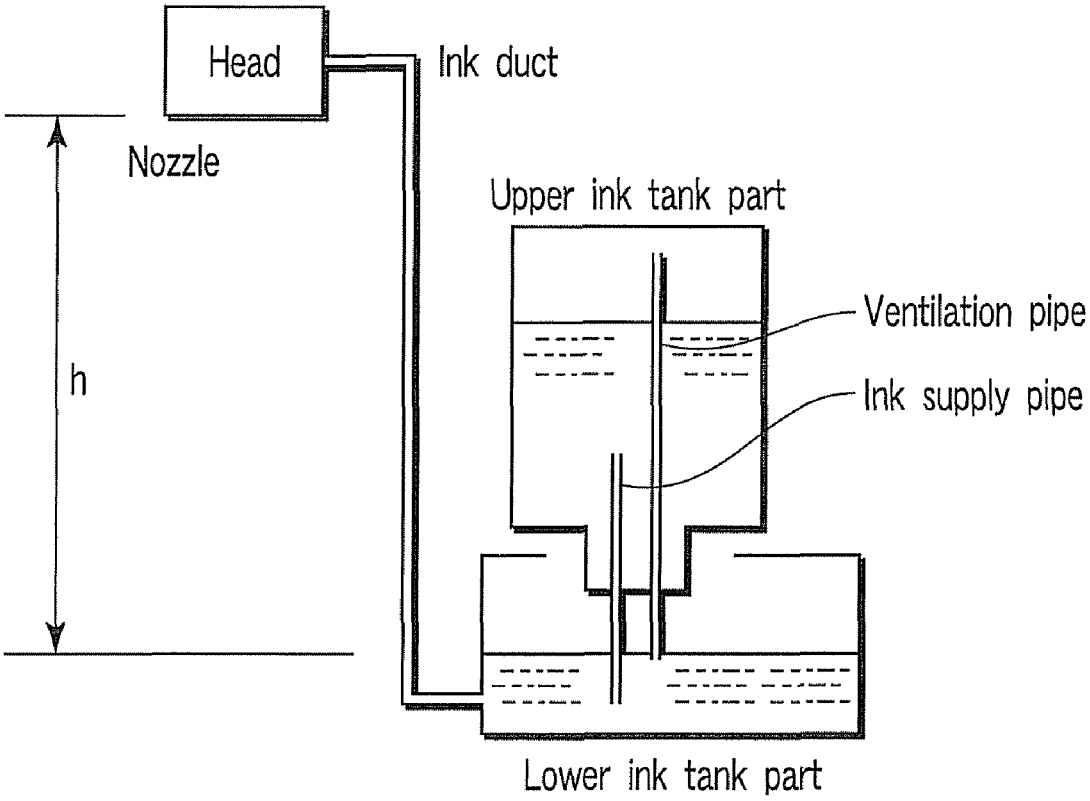
FIG. 11 is a view schematically showing the configuration of a traditional technique.

Here, the way to apportion the common ducts as parallel resistances will be described with reference to the equivalent circuit diagram shown in FIG. 9. The flow path resistances from the nozzle of the head 11 to the upstream and downstream branch points are expressed by R3 and R4. The flow path resistances from the nozzle of the head 12 to the upstream and downstream branch points are R5 and R6. The flow path resistance in the upstream common duct is R7. The flow path resistance in the downstream common duct is R8. In this case, R7 is apportioned as parallel flow path resistances R71 and R72, and R8 is apportioned as parallel flow path resistances R81 and R82.

The apportionment method may hold the following relations.

$$R71:R72=R81:R82=(R3+R4):(R5+R6)$$

$$1/R7=1/R71+1/R72$$

$$1/R8=1/R81+1/R82$$

In this case, R71:R81=R72:R82=R7:R8 holds.

The flow path resistance on the upstream of the nozzle of the head 11 is (R71+R3), the flow path resistance on the downstream of the nozzle of the head 11 is (R81+R4), the flow path resistance on the upstream of the nozzle of the head 12 is (R72+R5), and the flow path resistance on the downstream of the nozzle of the head 12 is (R82+R6).

Here, if R3:R4=R5:R6=R7:R8=1:r is set, (R71+R3):(R81+R4)=(R72:R5):(R82+R6)=1:r holds. Therefore, it can be said that the ratio of the upstream flow path resistance to the downstream flow path resistance as viewed from the nozzle is 1:r, without actually calculating R71, R72, R81 and R82.

Figure 10:
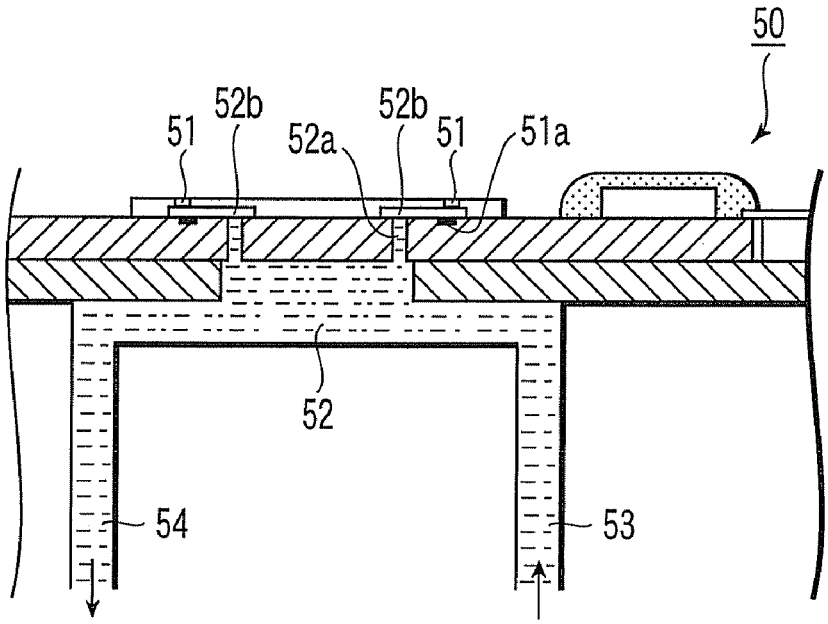
FIG. 10 is a partial sectional view showing a structure of an ink jet head according to a modification of the first embodiment of the invention.

The invention is not limited to the above embodiments, and it is a matter of course that, when carrying out the invention, various changes can be made with respect to the components of the invention including specific shapes of the component members without departing from the scope of the invention. For example, in the above embodiments, the configuration in which the ink 20 is ejected while being circulated via the pressure chamber 19 for the ink as shown in FIG. 2 is described as the configuration of the ink jet heads 11 to 16. However, the invention is not limited to this. A head having a pressure chamber and a nozzle at branched parts from the circulation path may be used, or a head block having independent heads at branched parts from the circulation path may be used. For example, as in an ink jet head 50 shown in FIG. 10, a technique of circulating and supplying ink to an ink storage unit 52 can also be applied. This ink jet head 50 has plural nozzles 51, heating elements 51*a* formed corresponding to these nozzles 51, an ink storage part 52, flow paths 53, 54 connected to the upstream and downstream of this ink storage part 52, and so on. As these flow paths 53, 54 are connected to the fourth duct 40 and the fifth duct 41 in the ink supplying mechanism 10 in each of the above embodiments, the same function as in the above embodiments and the same advantages as in the above embodiments can be achieved. In this form, pressure chambers 52*b* and the nozzles 51 where a meniscus is formed, are provided via slits 52*a* and away from the ink storage part 52. The ink storage part 52 can be considered to be branch points between the ink circulating part, and the pressure chambers 52*b* and the nozzles 51 via the slits 52*a*. When ink is circulated in such a head, if the heights of the surfaces of the ink storage part 52 and the nozzles 51 are almost the same, the meniscus pressures at the branch points and the nozzles are substantially equal when the ink is not ejected. Therefore, the ink pressure in the ink storage part 52 can be considered equal to the meniscus pressure of the nozzle in carrying out the operation. Also, when ejecting the ink, it may be considered that the meniscus pressure at the nozzle is lowered by the ejection flow rate multiplied by the flow path resistance from the branch point to the nozzle.

Moreover, the print head used in this ink jet recording apparatus may be of a type in which an intermediate part of the circulation path branches to the actuator and the nozzle via a filter. Also in this case, it can be considered that, in a non-ejection state, the nozzle pressure is the same as the pressure at the part where the primary side of the filter contacts the circulation path. When ejecting the ink, it may be considered that the nozzle pressure is lowered by the ejection flow rate multiplied by the flow path resistance from the primary side of the filter to the nozzle.

As the actuator 21, for example, a piezo type, piezo shared-mode type, thermal ink jet type and the like can be used, in addition to the actuator described in the embodiments.

Also, in the case where the orifice plate surface has plural nozzles openings and they have different heights, it can be considered that the average of the heights of the respective nozzles represents the height of the orifice plate surface as long as the difference in the pressure near the nozzles due to the difference in the height does not exceed the proper range of pressure near the nozzles. In this case, the direction of ink circulation flow in the head may be set from the side near the low nozzle to the side near the high nozzle, because this can reduce the difference in the pressure near the nozzles due to the difference in the height.

Also, adjustment of the flow rate Q and the height h in the embodiments may be made by presetting at the time of designing the ink jet recording apparatus 1 and the like, or by providing flow rate detection means and flow rate control means and detecting and controlling the flow rate Q and the like during printing.

Moreover, as the proper meniscus pressure range for forming a meniscus in order to provide proper ejection droplet shape without sucking air from the nozzles 17, the range of 0 kPa to −3 kPa is described. However, it is not limited to this range and it can be properly changed in accordance with the shape of each member in the ink jet recording apparatus. Also, the proper nozzle pressure range can be set to enable prevention of leakage and suction of the ink, for example, even in the state where predetermined vibration is applied to the ink jet recording apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and equivalents thereof.

What is claimed is:

1. An ink jet recording apparatus comprising:

an ink jet head having a pressure chamber facing a nozzle, and an upstream port and a downstream port connected to the pressure chamber;

a main tank connected to the ink jet head via the upstream port and capable of storing ink therein; and a sub-tank connected to the ink jet head via the downstream port and capable of storing ink therein;

wherein at least when printing by ejecting ink from the nozzle, the relation between ph, r, R and Q is held to satisfy $ph-\{QR\times(1/(1+r))\}=Pn$ (Pn being a constant representing a proper pressure in the nozzle), where ph represents a potential pressure in the main tank as viewed from a surface of an orifice plate where the nozzle of the ink jet head is formed, R represents a total flow path resistance from the main tank to the sub-tank via the ink jet head, a ratio of a flow path resistance from the main tank to the nozzle and a flow path resistance from the nozzle to the sub-tank is expressed by 1:r, and Q represents a flow rate of ink that circulates in a circulation path formed by connecting the ink jet head, the main tank and the sub-tank.

2. The ink jet recording apparatus according to claim 1, wherein the main tank and the sub-tank are installed above the nozzle.

3. The ink jet recording apparatus according to claim 1, wherein the value Pn is $0\geqq Pn\geqq -3000$ Pa.

4. The ink jet recording apparatus according to claim 1, wherein the main tank includes a lower tank in which a liquid surface is opened to atmosphere, and an upper tank connected to the lower tank via a ventilation path and an ink supply path.

5. The ink jet recording apparatus according to claim 1, wherein the ink is circulated in the circulation path formed by connecting the ink jet head, the main tank and the sub-tank, and the apparatus comprises an ink feed mechanism configured to be capable of adjusting the flow rate of the ink.

6. The ink jet recording apparatus according to claim 1, wherein the main tank has an adjustable height, and the equation can be held by adjusting the height.

7. The ink jet recording apparatus according to claim 1, comprising a valve configured to be capable of selectively opening to atmosphere or closing a liquid surface in the sub-tank.

8. The ink jet recording apparatus according to claim 1, comprising a plurality of the ink jet heads.

9. The ink jet recording apparatus according to claim 1, wherein the ratio r of the flow path resistance from the main tank to the nozzle and the flow path resistance from the nozzle to the sub-tank is set at 1.

10. The ink jet recording apparatus according to claim 1, wherein the ratio r of the flow path resistance from the main tank to the nozzle and the flow path resistance from the nozzle to the sub-tank is set to be less than 1.

11. The ink jet recording apparatus according to claim 1, wherein the ratio r of the flow path resistance from the main tank to the nozzle and the flow path resistance from the nozzle to the sub-tank is set to be larger than 1.

12. The ink jet recording apparatus according to claim 1, wherein the proper value of the meniscus pressure in the nozzle in the equation is set within a range that enables prevention of dripping of the ink from the ink jet head and suction of air into the nozzle.

13. The ink jet recording apparatus according to claim 1, wherein the proper value of the meniscus pressure in the nozzle in the equation is set within a range that enables prevention of dripping of the ink from the ink jet head and suction of air into the nozzle when vibration is applied to the ink jet head.

14. The ink jet recording apparatus according to claim 1, comprising a cap configured to be attachable to and removable from a distal end of the nozzle and capable of opening and closing an ejection port of the nozzle.

15. The ink jet recording apparatus according to claim 1, comprising a duct connecting the main tank to the upstream port, wherein the duct has a valve capable of opening and closing the circulation path.

16. The ink jet recording apparatus according to claim 1, comprising a detector configured to detect the flow rate, and a control device configured to adjust the flow rate in order to satisfy the equation in accordance with the result of the detection by the detector.

17. An ink supplying mechanism comprising:

an ink jet head having a pressure chamber facing a nozzle, and an upstream port and a downstream port connected to the pressure chamber;

a main tank connected to the ink jet head via the upstream port and capable of storing ink therein; and a sub-tank connected to the ink jet head via the downstream port and capable of storing ink therein;

wherein at least when printing by ejecting ink from the nozzle, the relation between ph, r, R and Q is held to satisfy $ph-\{QR\times(1/(1+r))\}=Pn$ (Pn being a constant representing a proper pressure in the nozzle), where ph represents a potential pressure in the main tank as viewed from a surface of an orifice plate where the nozzle of the ink jet head is formed, R represents a total flow path resistance from the main tank to the sub-tank via the ink jet head, a ratio of a flow path resistance from the main tank to the nozzle and a flow path resistance from the nozzle to the sub-tank is expressed by 1:r, and Q represents a flow rate of ink that circulates in a circulation path formed by connecting the ink jet head, the main tank and the sub-tank.

18. An ink jet recording method comprising circulating ink in a circulation path formed by connecting an ink jet head having a pressure chamber facing a nozzle and an upstream port and a downstream port connected to the pressure chamber, a main tank connected to the ink jet head via the upstream port and capable of storing ink therein, and a sub-tank connected to the ink jet head via the downstream port and capable of storing ink therein, at least when printing by ejecting ink from the nozzle, in a state where the relation between ph, r, R and Q is held to satisfy $ph-\{QR\times(1/(1+r))\}=Pn$ (Pn being a constant representing a proper pressure in the nozzle), where ph represents a potential pressure in the main tank as viewed from a surface of an orifice plate where the nozzle of the ink jet head is formed, R represents a total flow path resistance from the main tank to the sub-tank via the ink jet head, a ratio of a flow path resistance from the main tank to the nozzle and a flow path resistance from the nozzle to the sub-tank is expressed by 1:r, and Q represents a flow rate of ink that circulates in a circulation path formed by connecting the ink jet head, the main tank and the sub-tank.

* * * * *